United States Patent [19]

Kulp et al.

[11] 4,083,033

[45] Apr. 4, 1978

[54] TRAFFIC CONTROL ELEMENT

[75] Inventors: Jack H. Kulp, San Juan Capistrano, Calif.; James M. Florsheim, Northbrook, Ill.

[73] Assignee: Royal Industries, Inc., Pasadena, Calif.

[21] Appl. No.: 684,448

[22] Filed: May 7, 1976

[51] Int. Cl.[2] ..... E01F 9/00; E04H 17/00; G08B 23/00

[52] U.S. Cl. ..... 340/114 R; 116/63 P; 256/64

[58] Field of Search ..... 340/114 R, 114 B, 331, 340/; 256/64, 1; 248/176; 116/63 P; 240/2; 40/125 H, 125 N; D10/109, 111, 114

[56] References Cited

U.S. PATENT DOCUMENTS

| | | | |
|---|---|---|---|
| D. 237,473 | 11/1975 | Fitch | D10/109 |
| 2,719,505 | 10/1955 | Blumenthal | 40/125 N |
| 2,869,504 | 1/1959 | Andrews et al. | 116/63 P |
| 3,386,409 | 6/1968 | Dawson | 40/125 N |
| 3,475,009 | 10/1969 | Brown | 340/331 |
| 3,952,690 | 4/1976 | Rizzo et al. | 116/63 P |

*Primary Examiner*—Donald J. Yusko
*Attorney, Agent, or Firm*—Edward J. DaRin

[57] ABSTRACT

A traffic barrel constructed of a lightweight material consisting of two elements that may be readily assembled and stabilized in position and readily separated upon a substantial impact. The traffic barrel may mount one or two warning lights for nighttime traffic channelization purposes. The traffic barrel may have a "D" cross-section to prevent its rolling along a surface and have a stepped configuration to permit stacking of the two elements thereof.

50 Claims, 12 Drawing Figures

Fig. 9
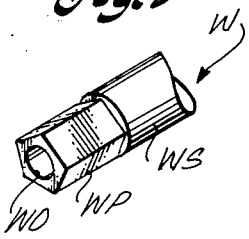
Fig. 10
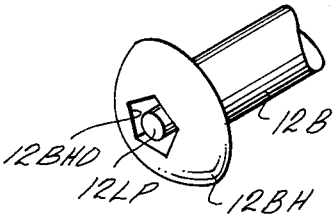
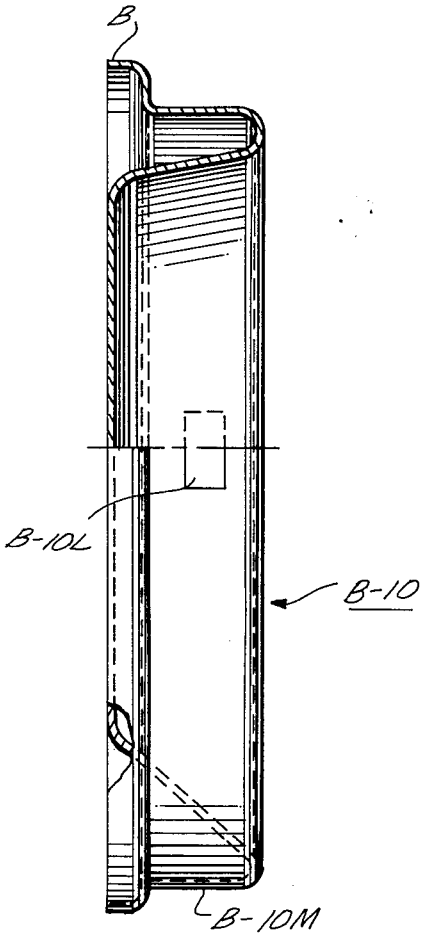
Fig. 7
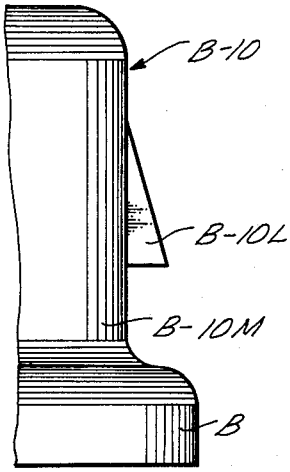
Fig. 8

TRAFFIC CONTROL ELEMENT

PRIOR ART AND SUMMARY OF THE INVENTION

This invention relates to a traffic control element and more particularly to a barrel-type traffic channelization element.

Drums, set on end, have been used for traffic warning, control and channelization. These traffic drums are normally made of metal and literally have the shape of an oil drum or the like with a capacity of 30–55 gallons. These drums must meet the specifications of the governmental entity having jurisdiction over the street, road, highway, freeway or similar public throughway on which they are used. Accordingly, some jurisdictions require that the drums be marked with stripes of contrasting color from the color of the drum proper and the minimum number of such stripes that must be provided, all as covered by the specifications of the particular governmental entity. For use, the drums must be provided with reflective surfaces and/or flashing or steady burning warning lights in accordance with the particular mode in which the drums are utilized. The color markings for such traffic drums covered by the Federal Government's specifications, for example, require that the drums to be marked with colors and markings that are consistent with the federal standards for the marking of barricades, namely, orange and white or black and white.

To avoid the handling problems inherent in the use of metal barrels utilized for traffic channelization, plastic drums have been developed and are presently in use. Plastic traffic barrels, obviously, provide less structural integrity and weight than metal drums but also have the further advantage of resulting in less motor vehicle damage or loss of control when impacted at high speeds than when a metal drum is impacted. Due to the reduction in weight of a plastic traffic control drum, the drum is desirable from the standpoint of handling, storage and transportation purposes. The lack of substantial weight of a plastic drum, however, requires that some means must be provided to stabilize such plastic drums to prevent them from being tipped over by high winds, minor vehicle impacts or the like so that the drums will remain in an upright position or will return to their original upright position upon impact. These prior art types of plastic barrels have also been designed to allow them to be readily stacked in a nested relationship for storage and transportation purposes and thereby exhibit further advantages over the metal traffic control drums. For nighttime use, the plastic drums have also been provided with a warning light.

Some of the present day plastic traffic control barrels closely resemble the appearance of a trash barrel and readily lend themselves to that use. Such trash-like traffic control plastic barrels have been borrowed by motorists traveling on the highways for their personal use as trash barrels. Other plastic traffic barrels that are presently in use have been found to readily buckle due to the weight of a warning light mounted thereon and do not provide any anti-theft means to deter or to prevent individuals from stealing the warning lights from the traffic barrels. Still other commercially available plastic traffic barrels do not provide a ready means to stabilize the barrel against being upset due to winds, minor impact and the like. It is presently popular to provide traffic control elements with reflective bands secured thereto to meet the governmental requirements for these traffic channelization elements. These reflective bands are easy to install on a traffic barrel but are expensive and can be readily damaged when a traffic control element provided with such a band is impacted. Further damage may result to the reflective bands when a barrel is knocked to a horizontal position and then rolls along the roadway or surface adjacent the road. Accordingly, in addition to the damage that will be caused to the barrel per se, damage may result to the reflective bands and the replacement of these bands is expensive, even though the barrel per se may be restored to its original condition. Accordingly, at the present time there is a need for an improved, relatively inexpensive, barrel-type traffic channelization element that is constructed of a lightweight material and avoids the aforementioned problems of the prior art type barrels and yet meets all of the specifications of the Federal Government and various other legal entities having jurisdiction over the use of such items.

The present invention provides an improved, relatively inexpensive, lightweight, stackable, barrel-type traffic control element that allows for ease of storage and transportation and yet does not appear to be a trash barrel so as to attract thefts. The unique outer configuration of the traffic control barrel of the present invention is a D-shaped cross-section that allows such a barrel to be manufactured relatively inexpensively as a result of requiring less material to manufacture the barrel proper, less reflective sheeting to cover the outer surface and allows more barrels to be stacked per square area providing economies in manufacture, use, storage and transportation. The D-shaped configuration provides a flat side for the barrel-like element which prevents it from rolling along a surface when impacted to the ground and thereby prevents the damage that normally is caused by such a rolling action. This D-shaped configuration for a traffic barrel further eliminated a potential traffic hazard, as well, since the barrel element cannot be readily blown into the flow of traffic due to its unique shape. The traffic barrel of the present invention may be constructed of two pieces that may be readily assembled together in a stabilized condition for traffic channelization purposes and yet the two pieces may be readily separated upon being impacted by a motor vehicle or the like to thereby further minimize damage to the traffic control element. The traffic barrel may be further provided with a warning light mounting means that allows a warning light or lights to be mounted to the traffic barrel in an anti-theft relationship.

Broadly, the traffic control barrel of the present invention comprises an element having a D-shaped configuration for temporarily mounting on a surface in an upright position for traffic channelization purposes. The D-shaped element may have a barrel-like appearance with a hollow D-shaped cross-sectional configuration and is preferably constructed of a resilient, plastic material. The barrel-like element is defined to have a stepped configuration wherein the smaller dimension of the element is located as the free end when mounted in an upright position to allow a plurality of the thus defined elements to be readily stacked.

From a specific construction standpoint, the traffic control element of the present invention comprises a hollow, barrel-like traffic control element having a substantially D-shape in cross-section and coacting with a base element adapted to be interfitted with one end of the traffic control element to mount the traffic control element in vertical position. The outer configuration of the traffic control element is further constructed and defined to be of a stepped configuration from the one end to the opposite end, with the larger end being interfitted with the base element. The traffic control element and the base element are also constructed and defined relative to each other to allow the ready assembly of the two elements and yet be responsive to a substantial impact by a motor vehicle or the like to allow the separation of the two elements. The traffic control element is further characterized as including access means for temporarily loading a ballast onto the base element by means of the traffic control element when the two are interfitted and readily unloaded therefrom when the two are disassembled. The two elements comprising the traffic control element may be constructed of a plastic material such as polyethylene plastic.

These and other features of the present invention may be more fully appreciated when considered in the light of the following specification and drawings in which:

FIG. 1 is a diagrammatic representation of a motor vehicle traveling on a public highway illustrating the traffic control element of the present invention positioned on the highway, with a portion of the element broken away, and embodying the present invention;

FIG. 8 is an enlarged detail view of the area of the base element identified by the detail line 8 of FIG. 3;

FIG. 9 is a partial, end perspective view of the operative end of the wrench illustrated in FIG. 5;

FIG. 10 is a partial, front perspective view of the bolt head for the bolt illustrated in FIG. 5;

Figure 2:
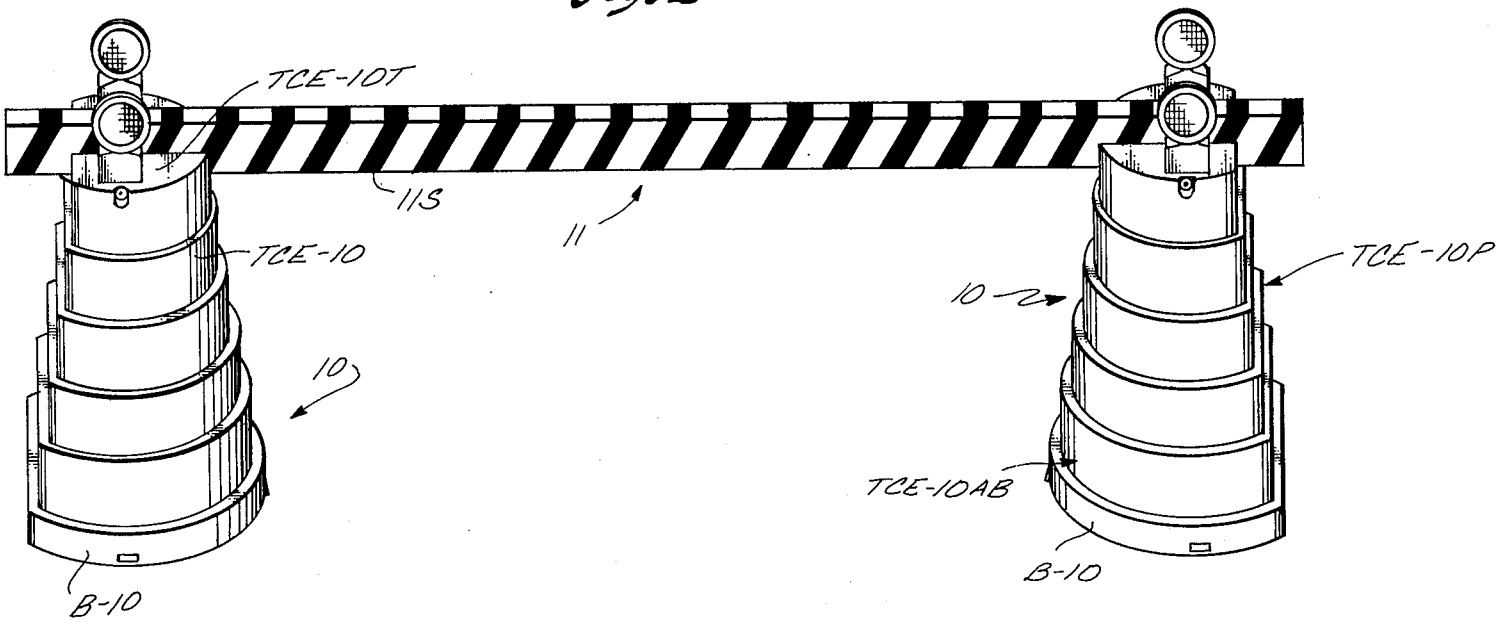
FIG. 2 is a front elevational view of a pair of traffic control elements of the type illustrated in FIG. 1 arranged to form a barricade.

Now referring to the drawings, the traffic control element 10 of the present invention will be described in detail. The traffic control element 10 may be utilized in a variety of fashions for traffic control, signalling and/or channelization and is illustrated in FIG. 1 as it may be positioned on a highway between traffic lanes for traffic channelization purposes. Similarly, a pair of such traffic control elements 10 are illustrated in FIG. 2 arranged with a board 11 mounted and secured to the top of each element 10 to form a barricade for traffic channelization by blocking off an area. The board 11 is provided with a plurality of stripes 11S arranged in a spaced apart relationship and of a color contrasting with the color of the board 11 proper. The board 11 may be black and white, for example, as illustrated in FIG. 2.

Figure 3:
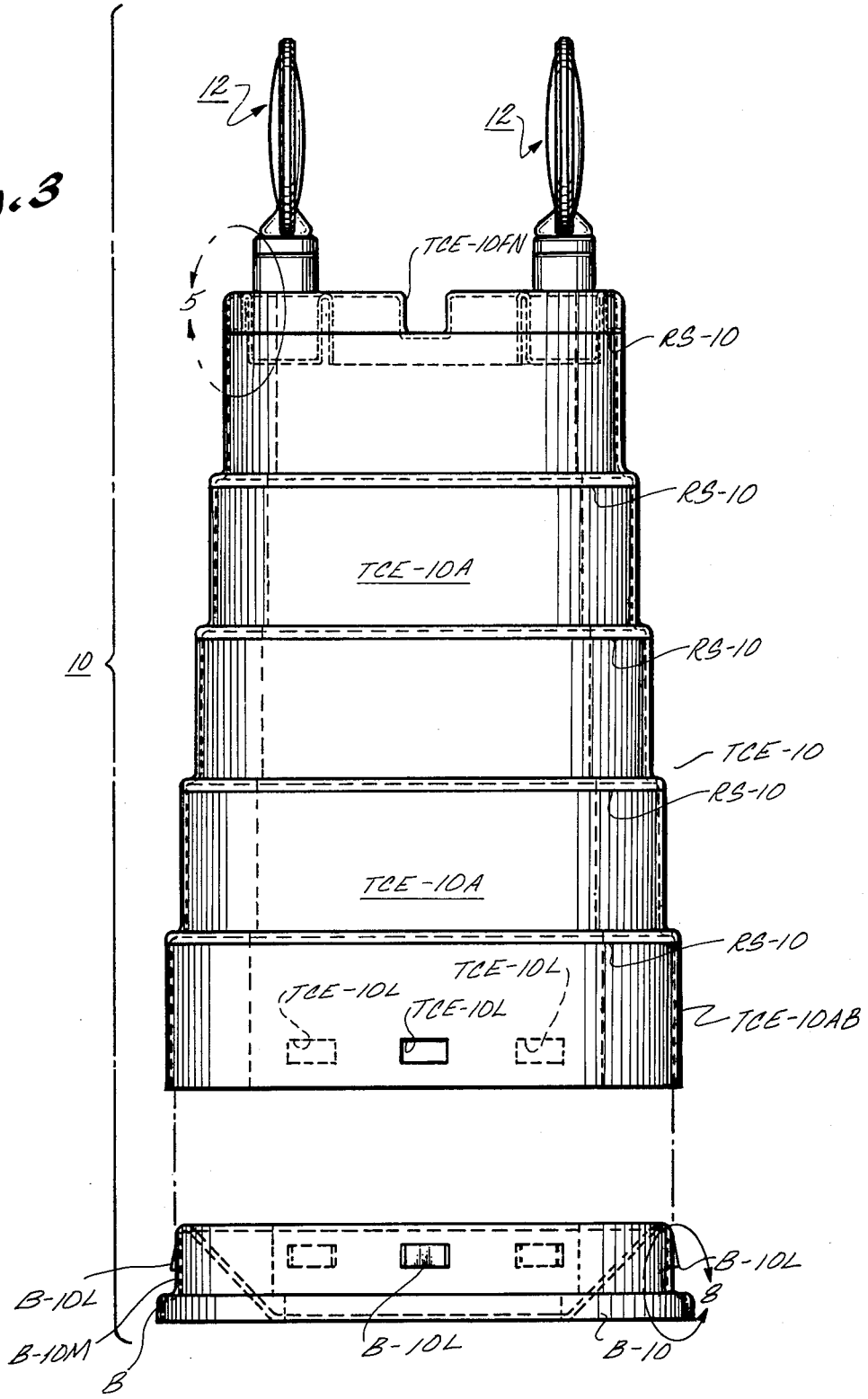
FIG. 3 is an exploded view of the component of the traffic control element illustrated in FIG. 1 with a pair of warning lights secured thereto.

The traffic control element 10 is illustrated in FIG. 3 in an exploded relationship for illustrating the components of the traffic control element 10 and their interrelationship. The components of the assembled traffic control element 10 comprise a traffic channelization element TCE-10 and a base element B-10. The two elements TCE-10 and B-10 are constructed and defined to be readily assembled into a one-piece unit for defining the traffic control element 10 and includes access means to allow it to be readily provided with a ballast or stabilization means, as illustrated in FIG. 1. The traffic control element 10 has the general configuration of a barrel and therefore is adaptable to be used for the same general purposes as present day traffic barrels may be used but with the additional advantages and features described herein which are not comprehended by prior art traffic barrels. In accordance with the teachings of the present invention, the general barrel shape is modified to have a generally D-shaped configuration in cross-section or to have a flat side TCE-10P, as is evident from examining the drawings. The traffic control element 10 may be defined to have one or two conventional warning lights 12 mounted on the top thereof for traffic warning and signalling purposes. The warning lights 12 may be a continuously burning light or a blinker light and are preferably mounted and secured to the traffic barrel element 10 in an anti-theft relationship. The traffic control element 10 preferably is constructed of a lightweight material such as a plastic and a high density linear polyethylene material has been found to be satisfactory in that it has the required structural integrity to be maintained in an upright position including when the warning lights are mounted and secured thereto and subjected to minor impacts.

Figure 5:
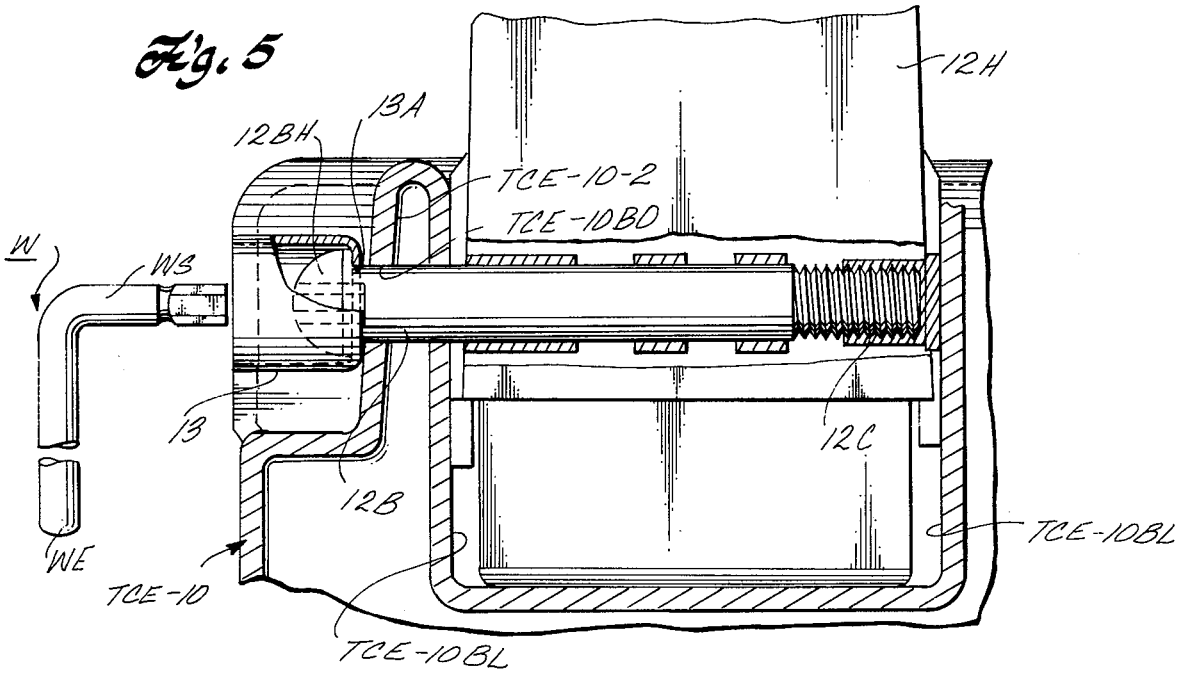
FIG. 5 is an enlarged detail view of the section of the traffic control element identified by detail line "5" of FIG. 3, with a wrench positioned adjacent thereto.
Figure 7:
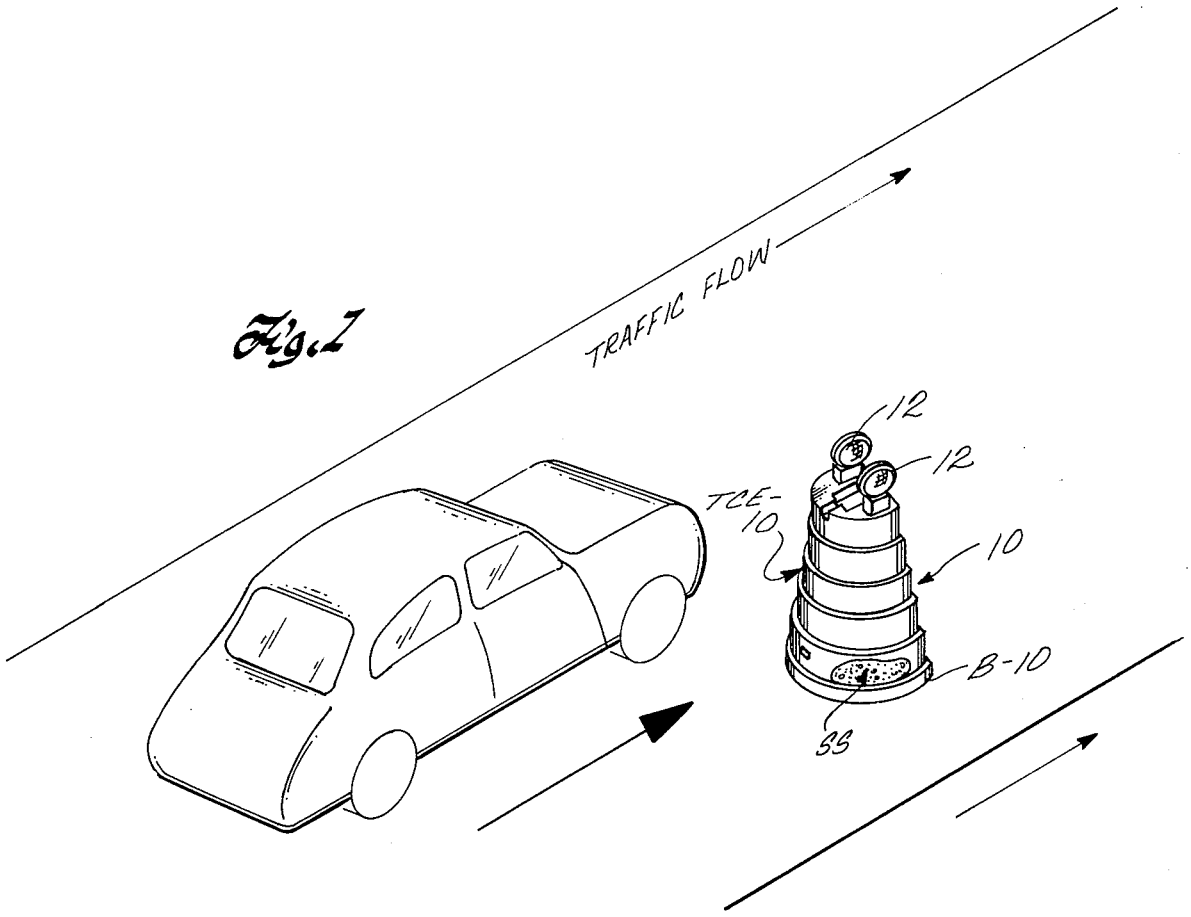
FIG. 7 is a partial elevational and sectional view of the base element taken along the line 7—7 of FIG. 6.
Figure 4:
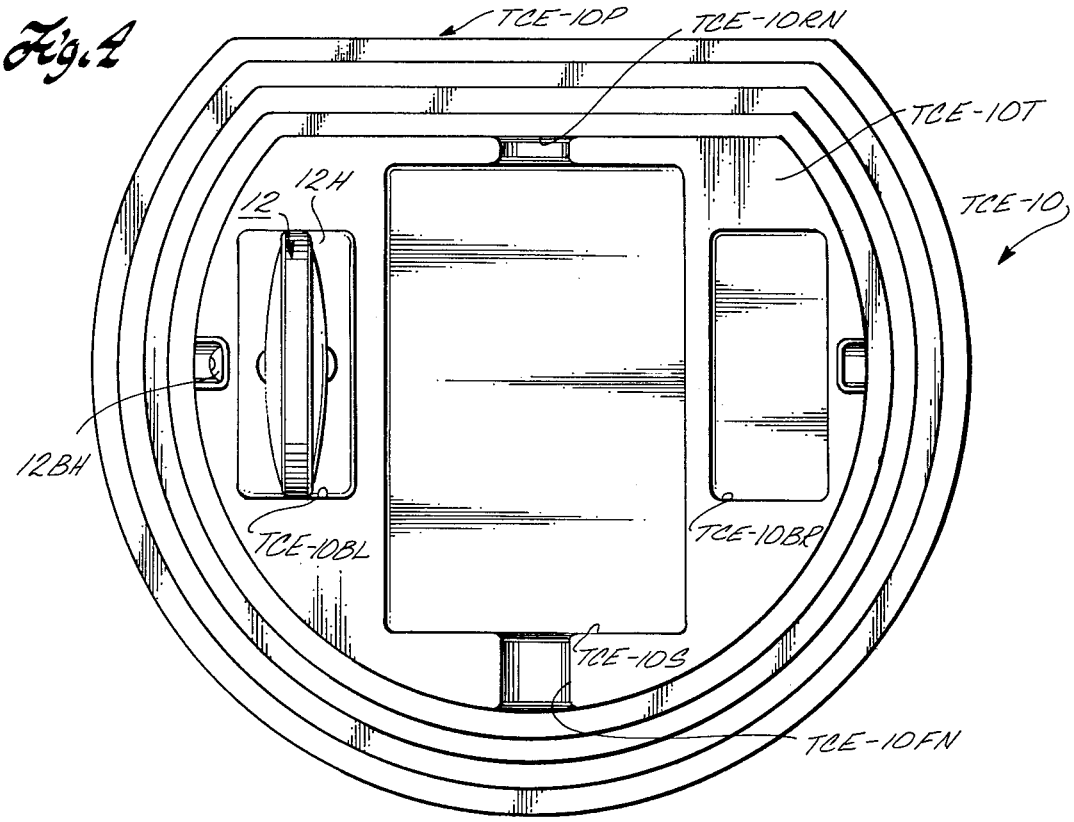
FIG. 4 is a top plan view of the detached traffic control element illustrated in FIG. 3 with one of the warning lights removed.

Referring to FIGS. 3–5, the detailed construction of the traffic control element 10 will now be examined. The general configuration of the traffic control element 10 is of a generally hollow cylindrical configuration having a flat or planar area on one side or the side identified as TCE-10-P and thereby providing the desired D-shape in cross section. The traffic control element 10 is also constructed and defined to have a stepped configuration between its ends, with the larger end being adapted to be interfitted with the base element B-10 as illustrated in FIG. 3. The stepped configuration is defined to provide a plurality of arcuate sections TCE-10A defined on the outer surface of the traffic control element 10 of successively decreasing diameter. Each arcuate section TCE-10A includes a planar surface or the back surfaces TCE-10-P to provide the desired flat surface. These arcuate sections TCE-10A of the traffic control element 10 may be provided with surface areas that contrast in color with the basic color of the traffic control element 10 proper. The contrasting color may be provided by means of commercially available sheeting secured to the traffic control element 10 by adhesives or the like. The commercially available sheeting secured to the traffic control element 10 may also include reflective properties for night time use and the reflective sections are illustrated with reflective sheets RS-10 secured thereto to cover a preselected area of the traffic control element 10 in a spaced apart relationship thereon; see FIG. 3. The reflective sheets RS-10 may extend completely around the arcuate sections TCE- 10A of the traffic control element 10 or extend only around each arcuate section to the planar surfaces TCE-10P thereof in accordance with the economics and requirements for the traffic channelization. It will be appreciated that wrapping the reflective sheeting RS-10 around the traffic control element 10 exclusive of the planar sections TCE-10P will still allow the element to be effective for traffic channelization purposes and yet reduce the overall initial cost and maintenance costs thereof. This advantage results since the traffic control element 10 is normally arranged with the arcuate surfaces TCE-10A facing the direction of traffic to be controlled and thereby be viewed by an oncoming motorist and pedestrian as is evident from FIG. 1. The bottom arcuate section of the traffic control element 10 has the largest outside diameter and is further identified as section TCE-10AB and is provided with a plurality of locking apertures TCE-10L. Five such apertures TCE-10L have been provided and are spaced around the section TCE-10AB for accepting and interlocking with the male locking elements provided on the base element B-10 as will be described hereinafter. The locking elements TCE-10L are illustrated as being of a rectangular configuration to receive the base element's male counterparts to allow the two elements TCE-10 to be readily assembled and separated from one another.

The upper arcuate section TCE-10A for the traffic control element 10 is constructed and defined with a planar top surface TCE-10T having a plurality of openings identified as the openings TCE-10BL, TCE-10BR and TCE-10S. The openings identified as TCE-10BL and TCE-10BR are constructed and defined as wells for accepting and storing a commercially available warning light or blinker light to be slipped therein with a minimum of clearance and secured to the traffic control element 10. These warning light wells TCE-10BL and TCE-10BR are defined on the top surface TCE-10T of the traffic control element 10 near the peripheral edges thereof in order that the light emitted from a warning light mounted therein will be placed near the traffic. This light mount arrangement is in contrast to the prior art mounting of the lights centrally of the top section of a traffic control barrel thereby leaving one-half of the traffic barrel's width between the warning light and the traffic thereby rendering the warning light's illumination more effective for traffic purposes. The opening TCE-10BL and TCE-10BR are constructed and defined to slidably accept what is known in the art as a Type A barricade light of the type that is commercially available from the Signal Division of Royal Industries, 1370 Esperanza Street, Los Angeles, California. The provision of two light wells arranged as illustrated allows a pair of warning lights to be advantageously used when the traffic control element 10 is placed between opposing lanes of traffic as it is arranged in FIG. 1. Although two warning lights 12 are illustrated in FIGS. 1–3 mounted to the traffic control element 10, one of the lights 12 is omitted in FIG. 4 to better illustrate the relationship of the battery wells relative to the top surface TCE-10T of the traffic control element 10. It will be appreciated that in some applications a single light is sufficient.

The warning light 12 is normally provided with a retainer bolt to allow it to be mounted and secured to a barricade. The same mounting bolt may be used for the purposes of mounting a light 12 to the traffic control element 10 and is preferably mounted thereto in an anti-theft relationship. The light mounting arrangement is illustrated in detail in FIG. 5. At this point it should be noted that the battery housing 12H of the warning light 12 is illustrated mounted in the warning light well TCE-10BL and is secured thereon in an anti-theft relationship. The warning light well TCE-10BL is constructed and defined to have a width to correspond to the width of the battery housing 12H for the warning light 12 so as to be precisely mounted therein with a minimum amount of clearance. The battery housing securing bolt 12B normally provided with a warning light is secured with a retainer cup 12C having internal threads for receiving the bolt in a threaded relationship at its free end. The cup 12C is secured to the inner wall of the housing 12H as the light is normally sold; see FIG. 5.

The left hand end of the battery well TCE-10BL is constructed and defined with a bolt opening TCE-10BO for receiving a portion of the shank of the bolt 12B adjacent its bolt head 12BH. To prevent the warning light 12 from being readily removed from the traffic control element 10, a doubled walled construction is provided for the element 10 in the area providing the bolt opening TCE-10BO in the areas most likely to be severed or cut in an attempt to steal the warning light 12. The double walled thickness is illustrated in FIG. 5 wherein a portion of the plastic of the traffic control element 10 is bent back upon itself in a spaced, reentrant relationship and which plastic section is identified by the reference numeral TCE-10-2. For anti-theft purposes, an anti-theft, security cup 13 is provided for the bolt 12B so as to be mounted adjacent the bolt head 12BH. The security cup 13 has a central opening 13A at the closed end of the cup 13 to receive the shank of the bolt 12B. When the cup 13 is mounted to the bolt shank 12B in an orientation so that the open end of the cup 13 will be extended over and beyond the bolt head 12BH with the cup aperture 13A aligned adjacent the inside surface of the bolt head 12BH. In this fashion, the cup 13 prevents access to the bolt head 12BH by conventional tools and thereby prevents the warning light 12 from being readily removed from the traffic control element 10.

The bolt head 12BH has a special configuration to accept a special wrench W to allow only authorized individuals to release the bolt 12B from the battery housing 12H when secured as illustrated in FIG. 5. The bolt head 12BH having an anti-theft configuration is best appreciated from examining FIG. 10. The front face of the bolt head 12BH has a central opening 12BHO having a pentagonal shape extending inwardly from the face of the bolt head 12BH a preselected distance. The central area of the opening 12BHO is provided with a wrench locking pin 12LP substantially coextensive therewith and spaced from the inner edges of the opening 12BHO. To allow the bolt 12 to be secured and released from the battery housing 12H by means of the bolt head 12BH, a special wrench W having a male complementary configuration to the configuration of the opening 12BHO is provided for this opening. The wrench W is a round bar which may have a 90° bend, as illustrated in FIG. 5, with the dependent end WE functioning as a wrench handle and with the short end WS of the wrench having the male configuration allowing it to be inserted and locked to the opening 12BHO of the bolt head 12BH. For this purpose the short end WS of the wrench W is provided with a pentagonal shpaed section WP extending a preselected distance inwardly from the free end and corresponding to the shape of the pentagonal opening 12BHO for the bolt head 12BH so as to be slidably received and secured at the opening of the bolt head 12BH. For this purpose, the end of the pentagonal shaped section WP is provided with a circular opening WO arranged centrally thereof and extending a preselected distance therein so as to interlock in a secure relationship with the pin 12LP provided for the bolt head 12BH. The lengths selected for the pin 12LP and the opening WO are selected to provide a secure male-female interlock for releasing and securing the bolt 12B. Similarly, the relative tolerances for the opening 12BHO for the bolt head 12BH and pentagonal end WP provides a secure, non-slip interlock between the wrench W and the bolt head 12BH. In this fashion, the wrench W may be secured to the bolt 12BH to allow it to be secured to the battery housing 12H or removed therefrom. It should now be appreciated that this anti-theft construction dictates that the special wrench W must be employed with the bolt 12B to allow an auzhorized individual to have access to the bolt head 12BH.

The remaining opening defined in the top surface of the traffic control element 10 is the access opening TCE-10S. This opening TCE-10S is defined centrally of the top surface TCE-10T of the traffic control element TCE-10 intermediate to the battery wells TCE-10BL and TCE-10BR. This opening TCE-10S allows access to the hollow interior of the traffic control element TCE-10 to allow a convenient form of stabilization means to be mounted to or retained by the base element B-10 for stabilizing the assembled traffic control element 10 at its desired location. The means that may be used to stabilize the traffic control element 10 may be sand, gravel, sand bag or a cinder block which may be positioned through the opening TCE-10S so as to be stored on the internal surface B-10I provided for the base element B-10. This relationship of the stabilizing means can be best appreciated from examining the stabilizing sand SS identified at the broken away section of FIG. 1. Arranged on the opposite ends of the access opening TCE-10S from the battery wells TCE-10BL and TCE-10BR are a pair of barricade notches TCE-10FN and TCE-10RN. These two barricade notches are defined to be in communication with the adjacent ends of the access opening TCE-10S to permit a board to be mounted so as to extend therebetween. The barricade notch facing the front section of the traffic control element 10 is identified as a notch TCE-10FN while the rear notch is identified as the notch TCE-10RN. These barricade notches TCE-10FN and TCE-10RN extend downwardly from the top surface TCE-10T of the traffic control element 10 a preselected distance to accept various sizes of barricade boards, bars or similar planar elements. These barricade bars may be provided through use of boards in the form of boards having 2 × 4 inch, 2 × 6 inch or 2 × 8 inch dimensions and having a preselected length. One such planar element 11 is illustrated in its mounted relationship in FIG. 2. The elements 11 may be mounted and secured to the notches TCE-10FN and TCE-10RN for the traffic control elements 10 when they are both rotated 90° from their normal position (FIG. 1) or the positions illustrated in FIG. 2. The element 11 will extend between the previously positioned traffic control elements 10 and by positioning it into the pair of corresponding notch TCE-10FN and TCE-10RN and access openings TCE-10S, as can be appreciated from examining FIG. 2. This will allow the traffic control elements 10 to function as a barricade to block out a particular area from traffic as well as traffic channelization.

It should be appreciated that although a pair of warning light wells are illustrated in conjunction with the traffic control element 10 that only one such well may be provided if the governmental specification will be so met. The one warning light may be mounted in one of the wells TCE-10BL or TCE-10BR or a single well may be defined in conjunction with the access opening TCE-10S which may be readily modified to allow a warning light to be mounted thereon as well as functioning as an access opening for mounting the ballast into the traffic control element 10.

Figure 6:
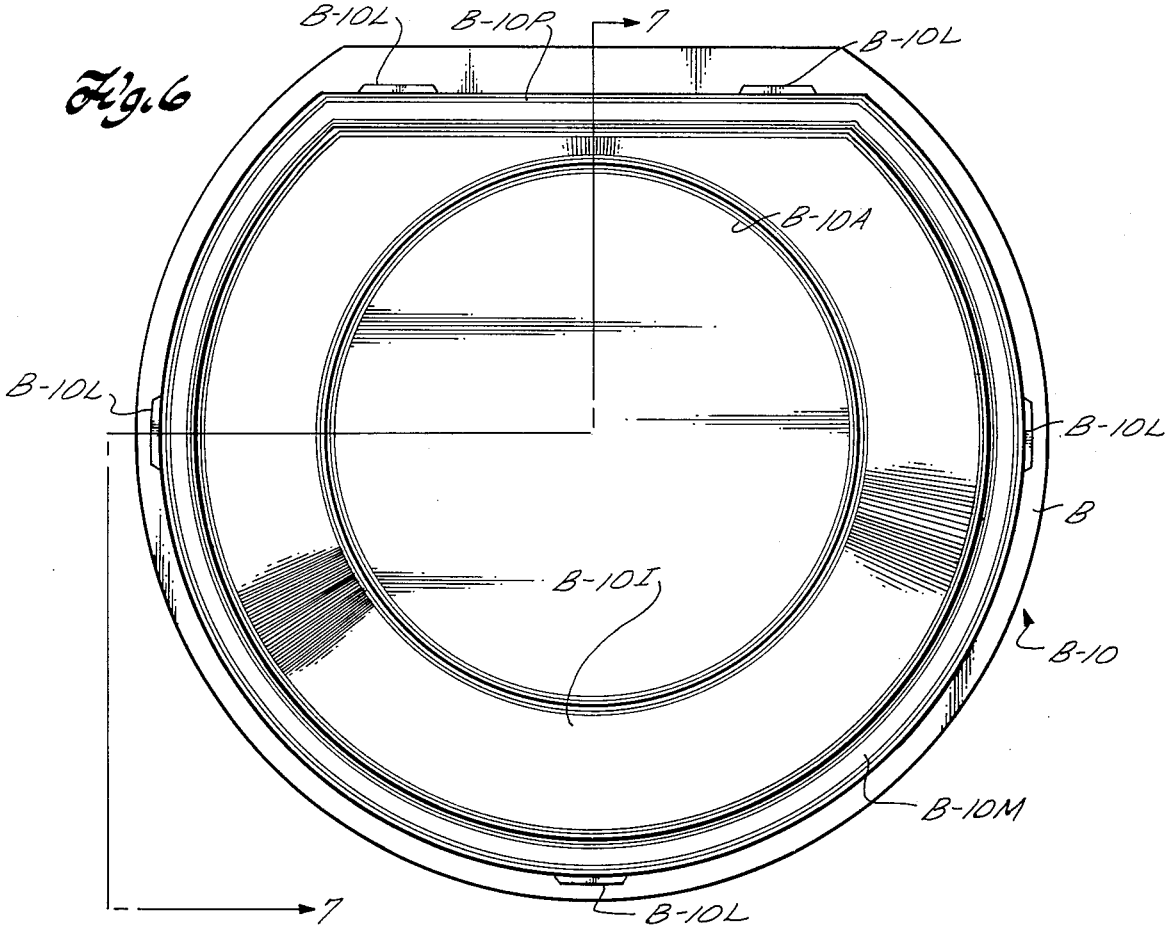
FIG. 6 is a top plan view of the detached base element of the traffic control element as illustrated in FIG. 3.

Now referring to FIG. 6, the construction of the base element B-10 for the traffic control element will be described in detail. The base element B-10 is constructed and defined to be readily assembled or interfitted with the traffic channelization element TCE-10 to form the traffic control element 10. The base element B-10 is also defined to have a cross section of a D-configuration and for receiving the larger end or the section TCE-10AB of the element TCE-10. For this purpose the base element B-10 is also constructed of a stepped configuration with an upstanding mounting surface B-10M being defined in an arcuate fashion above the base section B proper and a planar surface B-10P for interfitting with the element TCE-10. For this purpose, a plurality of locking elements B-10L are provided to extend outwardly of the surface B-10M so as to interfit with the locking opening TCE-10L provided for the traffic channelization element TCE-10. Five such locking elements B-10L are illustrated in FIG. 6 with two of them arranged at the flat side B-10P of the upstanding section B-10M and the other three being equally spaced around the arcuate section of B-10M, as is evident from examining FIG. 6. An enlarged view of the locking element B-10L is illustrated in elevation in FIG. 8 so as to better appreciate how the male elements B-10L are interlocked with the openings TCE-10L and readily assembled and disassembled in accordance with the teachings of the present invention. The base element B-10 is also provided with a ballast mounting surface or lip B-10I extending inwardly therefrom a preselected distance and having a central aperture B-10A defining the inner extremity of the lip. The ballast surface B-10I is defined to extend inwardly a sufficient distance so as to provide sufficient surface area to receive the selected stabilization means (sand, gravel, or a cement block) to stabilize the traffic control element 10 in its desired position in which it is mounted on the highway, etc.

It will be appreciated that once the traffic channelization function of the element 10 is complete and it is desired to move the element to a new location that it can be readily disassembled by separating or pulling apart the traffic channelization section TCE-10 and the base element B-10 to detach or unlock the locking elements B-10L and TCE-10L. The removal of the element TCE-10 from the base B-10 will expose the stabilizing means which can either be removed from the surface B-10I or readily dumped therefrom with a minimum of time and effort. It should also be appreciated that the construction of the locking elements TCE-10L and B-10L are merely exemplary of one technique for allowing the elements to be readily assembled or disassembled. An important consideration from the standpoint of selecting a locking arrangement for the traffic control elements TCE-10 and B-10 is that the locking arrangement be constructed and defined in the manner described hereinabove to allow the traffic control element TCE-10 to be separated from the base element B-10 when it is impacted by a substantial force that may result upon being struck by motor vehicles or the like moving at high speed. When such an impact results, the element TCE-10 will be knocked to the ground and remain essentially at the spot in which it lands after impact. This results due to the provision of the flat surfaces TCE-10P for the element TCE-10 which will prevent the element from rolling along the surface of the road or the surface adjacent a highway after impact or to be blown along the surface by a high wind after it lands on the ground. This, then, will minimize the damage to the traffic control element 10 and to the reflective surfaces RS-10. It should also be noted that in the event the lightweight material employed for constructing the element 10 is dented, that it should allow it to be pushed back to its original condition by pushing the dented area outwardly to restore it to its normal shape by applying force on the inside of the dented surface. The polyethylene plastic selected for constructing the element 10 exhibits this property. This will allow the elements 10 to be readily re-used and re-assembled for further traffic channelization purposes without the need for replacement.

Figure 12:
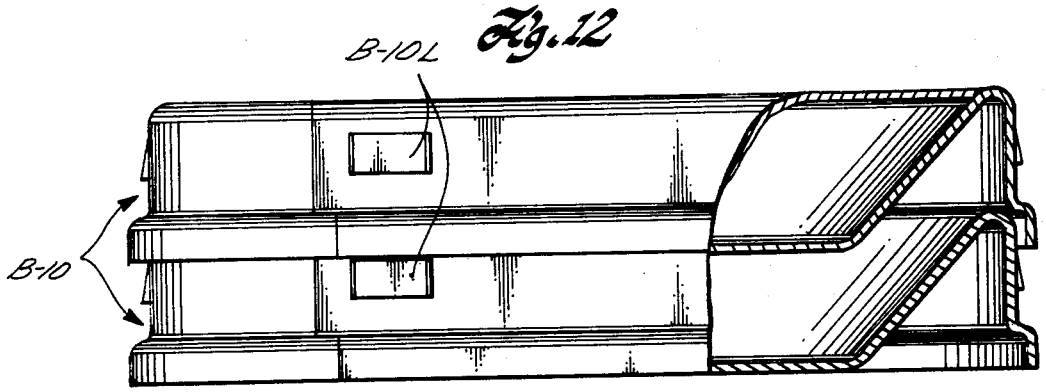
FIG. 12 is an elevational view, with portions broken away, of a pair of stacked base elements for the traffic control element.
Figure 11:
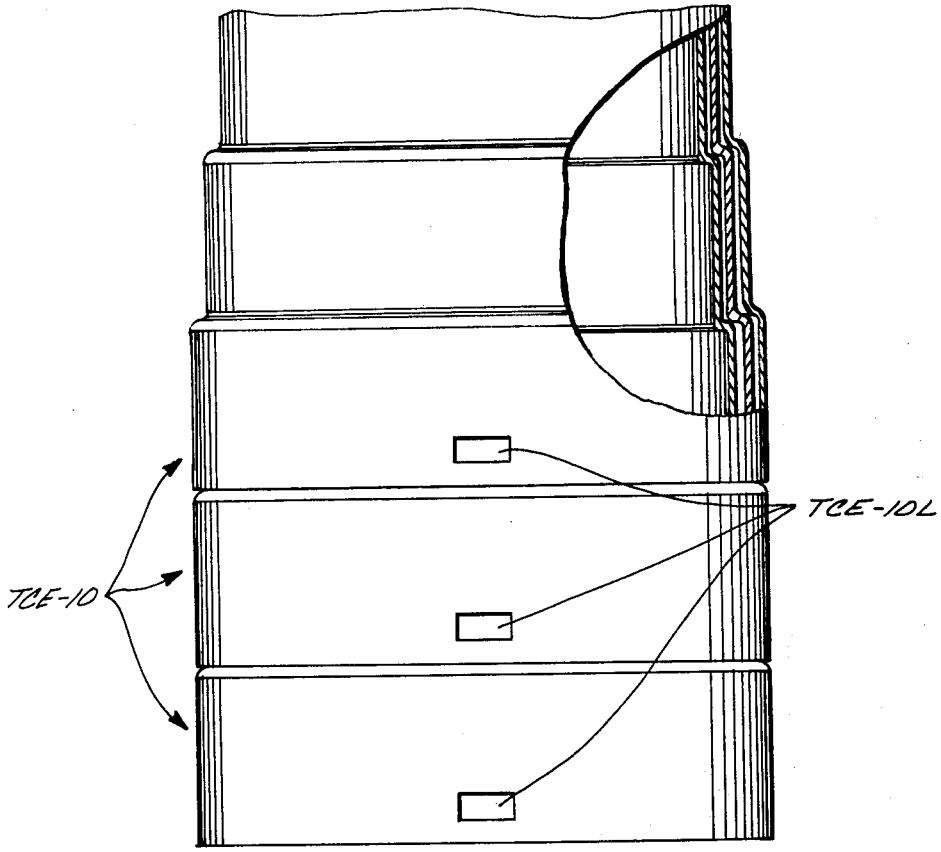
FIG. 11 is an elevational view, with portions broken away, of a plurality of traffic channelization components of the traffic control element arranged in a stacked, nested relationship.

In addition to the ability to readily assemble and disassemble the traffic control element 10, it has been provided with the stepped configuration so that a plurality of similar elements may be stacked in a nested relationship, one upon the other, as illustrated for the elements TCE-10 in FIG. 11. FIG. 11 illustrates three of the elements stacked together. This stacking ability allows more traffic control elements to be stored in a given area that when prior art type non-stackable traffic control barrels are employed, such as is true with metal traffic barrels and some plastic barrels. Similarly, the base elements B-10 may be stacked in a nested relationship, one upon another, as illustrated in FIG. 12. The ability to stack the traffic control barrels of the present invention provides economics in storing and/or transporting the lightweight barrels.

The traffic control element 10 comprising the separable elements TCE-10 and B-10 may be relatively inexpensively manufactured from lightweight materials such as plastics due to the configurations selected to minimize the amount of material required for manufacturing purposes. This is particularly evident upon consideration of the savings of material that results from the definitions of a flat side for the element as well as the stepped configuration and hollow shape for both the base element as well as the traffic channelization element. The selection of a polyethylene plastic material also allows construction of the traffic control element by rotational molding practices.

What is claimed is:

1. A traffic channelization element comprising an element having a D-shaped configuration for temporarily mounting on a surface in an upright position for traffic signaling and channelization, said element having a barrel-like appearance with a hollow D-shaped cross-sectional configuration and being constructed of a resilient plastic material and is defined to have a stepped configuration wherein the smaller dimension of the element is at the free end of the element when mounted in an upright position.

2. A traffic channelization element as defined in claim 1 including means for allowing access to the interior of the element to allow for the loading of a ballast into the element for stabilizing the element in an upright position.

3. A traffic channelization element as defined in claim 2 wherein the element is provided with an aperture for loading ballast therein.

4. A traffic channelization element as defined in claim 2 wherein the element is provided with a substantially central aperture at the top side thereof for loading ballast and means for mounting at least a single electrically operated warning light to the top side thereof.

5. A traffic channelization element as defined in claim 4 wherein said means for mounting a warning light comprises a pair of wells arranged on opposite sides of the central aperture for mounting a warning light in each well.

6. A traffic channelization element as defined in claim 5 wherein each well includes means for securing a warning light to the element.

7. A traffic channelization element comprising an element having a D-shaped configuration for temporarily mounting on a surface in an upright position for traffic signaling and channelization, the upper section of the D-shaped element being constructed and defined with means for securing a longitudinal planar element thereto whereby a pair of the thus defined elements may function as a barricade with the planar element extending between and secured to each of said elements.

8. A traffic channelization element comprising an element having a D-shaped configuration for temporarily mounting on a surface in an upright position for traffic signaling and channelization, said element being constructed of two pieces, one of the pieces being a base member and the other piece being the traffic channelization element adapted to be assembled and disassembled to the base member whereby upon impact the traffic channelization element will be separated from the base member to thereby minimize damage thereto and allowing ready reassembly of the two elements for reusability.

9. A traffic channelization element as defined in claim 8 wherein the D-shaped element includes a plurality of bands secured in a spaced apart relationship on the element, each of the bands being of color selected to contrast with the color of the element.

10. A traffic channelization element as defined in claim 9 wherein the element includes light reflecting means.

11. A traffic channelization element as defined in claim 10 wherein said light relfecting means includes at least a single light reflective band secured to the element.

12. A traffic channelization element as defined in claim 10 including an electrically operated warning light mounted to the upper end of the D-shaped element.

13. A traffic control element comprising a hollow element having an arcuate configuration with at least one flat side so that when the flat side is arranged in a vertical position it will prevent the element from readily rolling when impacted to a horizontal position, the outer configuration of the element being further constructed and defined to be of a stepped configuration from the element mounting surface to the top surface thereof to thereby allow a plurality of the thus defined elements to be stacked in a nesting relationship.

14. A traffic control element as defined in claim 13 including a plurality of reflectorized stripes secured to the outside surface of the element in a spaced apart relationship.

15. A traffic control element as defined in claim 14 including means constructed and defined for mounting a warning light to the element.

16. A traffic control element as defined in claim 15 including a warning light mounted to the element and anti-theft means for securing the warning light to the element.

17. A traffic control element as defined in claim 13 including means constructed and defined at one end of the element for receiving and mounting a warning light including means for securing the warning light to the element.

18. A traffic control element as defined in claim 17 wherein the warning light is a battery operated flashing light and includes anti-theft means for securing the light to the element.

19. A traffic channelization element comprising:

a hollow element having an arcuate configuration with at least one flat side and a base element adapted to be readily assembled and separated from the hollow element; the hollow element being mounted to the base element in a vertical position to expose the flat side thereof.

20. A traffic channelization element as defined in claim 19 wherein the hollow element includes means for loading a ballast such as sand, gravel or the like into the hollow element and stored in the base for stabilizing the traffic channelization element.

21. A traffic channelization element as defined in claim 20 including means for mounting and securing a warning light adjacent the top end of the hollow element.

22. A traffic channelization element as defined in claim 19 wherein the outer configuration of the hollow element is further constructed and defined to be of a stepped configuration with the largest outside dimension being adapted to be mounted to the base element and the smaller outside dimension being adjacent the outer end of the element to thereby allow a plurality of the elements to be stacked in a nested relationship when separated from the base element.

23. A traffic channelization element as defined in claim 22 wherein the base element is constructed with an enclosed end for receiving ballast means to stabilize the base when mounted to the hollow element, the base element having an outer configuration to be nested to and secured to the larger end of the hollow element.

24. A traffic channelization element as defined in claim 23 wherein the base element and the hollow element are constructed and defined in a complimentary configuration to be snap locked together.

25. A traffic control element comprising:

a hollow barrel-like traffic control element having a substantially D-shape in cross section, and a base element adapted to be interfitted with one end of the traffic control element to mount said element in a vertical position, the outer configuration of the traffic control element being further constructed and defined to be of a stepped configuration from one end to the opposite end with the larger end being interfitted with the base element, the traffic control element and the base element being constructed and defined relative to each other to allow the ready assembly of the two elements and yet be responsive to a substantial impact by a motor vehicle or the like to allow separation of the traffic control element from the base element, the traffic control element being further characterized as including access means for temporarily loading a ballast onto the base element by means of the traffic control element when the two are interfitted and to be unloaded therefrom when the two are disassembled.

26. A traffic control element as defined in claim 25 wherein the two elements are constructed of a plastic material.

27. A traffic control element as defined in claim 26 wherein the two elements are constructed of a polyethylene plastic material.

28. A traffic control element as defined in claim 25 wherein the traffic control element has its outer surface, at least in part, constructed of circumferential bands arranged in a spaced apart relationship and having a color contrasting with the color pre-selected for said element.

29. A traffic control element as defined in claim 28 wherein the bands include light reflecting properties.

30. A traffic control element as defined in claim 25 wherein the traffic control element is further constructed and defined to include means for permitting a warning light to be mounted to the upper end of said element and yet maintaining said access for loading ballast.

31. A traffic control element as defined in claim 30 wherein the traffic control element has its upper end constructed with at least a single warning light well arranged adjacent the outer periphery thereof to receive and mount a warning light therein and an access aperture for loading ballast defined in said upper end and spaced from the warning light well.

32. A traffic control element as defined in claim 31 wherein the traffic control element includes a pair of warning light wells for receiving and mounting a warning light in each well.

33. A traffic control element as defined in claim 31 including a pair of notches defined on the upper end of the traffic control element adjacent diametrically spaced points on the periphery thereof and communicating with said access aperture.

34. A traffic control element as defined in claim 25 wherein the upper end of the traffic control element is constructed and defined for providing means to mount a planar element thereto.

35. A traffic control element as defined in claim 34 including a second similarly defined traffic control element and a bar extending between the traffic control elements and secured by said mounting means.

36. A traffic control element as defined in claim 30 including a battery operated warning light mounted to the upper end of the element at said mounting means.

37. A traffic control element as defined in claim 30 wherein the two elements are constructed of plastic and the traffic control element has its outer surface defined with circumferential bands arranged in a spaced apart relationship and extending around at least the arcuate portion of said element, the element having a preselected color and the bands having a color selected to contrast therewith.

38. A traffic control element as defined in claim 37 including light reflecting means constructed and defined with said traffic control element.

39. A traffic control element as defined in claim 37 wherein said bands include light reflecting properties.

40. A traffic control element as defined in claim 39 wherein the two elements are constructed of a polyethylene plastic material.

41. A traffic control element comprising a hollow barrel-like element having an arcuate configuration with at least one flat side so that when the flat side is arranged in a vertical position it will prevent the element from rolling when impacted to a horizontal position, and a base element for said barrel-like element having an arcuate configuration with at least one flat side for mounting said element in an upright position, the base element and said barrel-like element being constructed and defined to be readily assembled together and being responsive to a substantial impact to cause the barrel-like element to become separated from the base element thereby minimizing any damage thereto.

42. A traffic control element as defined in claim 41 wherein said elements are constructed and defined to be assembled together with the flat sides thereof arranged on the same side of the traffic control element.

43. A traffic control element as defined in claim 42 including means for loading stabilizing means into the base element to be stored therein when the two elements are assembled together.

44. A traffic control element as defined in claim 43 wherein said elements are constructed of a lightweight, resilient plastic material having a preselected color.

45. A traffic control element as defined in claim 41 wherein said barrel-like element includes means for mounting and securing a warning light to said element.

46. A traffic control element as defined in claim 45 including anti-theft means for securing a warning light to said element.

47. A traffic control element as defined in claim 45 including a warning light mounted and secured to said element in said mounting means.

48. A traffic control element as defined in claim 42 wherein said hollow barrel-like element is tapered from the base securing end to the opposite end for permitting a multiplicity of said elements to be stacked upon one another.

49. A traffic control element as defined in claim 48 wherein said elements are constructed of a resilient, polyethylene plastic permitting restoration to its normal shape upon being dented.

50. A traffic control element as defined in claim 48 wherein the base element has an outer configuration constructed and defined to allow a plurality of said base elements to be stacked in a nesting relationship when they are separated from their barrel-like elements.

* * * * *